US010655503B2

(12) United States Patent
Otani et al.

(10) Patent No.: US 10,655,503 B2
(45) Date of Patent: May 19, 2020

(54) STEAM TURBINE CASING

(71) Applicant: MITSUBISHI HITACHI POWER SYSTEMS, LTD., Kanagawa (JP)

(72) Inventors: Yukihiro Otani, Tokyo (JP); Takahiro Miyamoto, Tokyo (JP); Tomoyuki Onishi, Tokyo (JP); Katsuhisa Hamada, Yokohama (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 331 days.

(21) Appl. No.: 15/531,552

(22) PCT Filed: Nov. 24, 2015

(86) PCT No.: PCT/JP2015/082910
§ 371 (c)(1),
(2) Date: May 30, 2017

(87) PCT Pub. No.: WO2016/088603
PCT Pub. Date: Jun. 9, 2016

(65) Prior Publication Data

US 2017/0328238 A1 Nov. 16, 2017

(30) Foreign Application Priority Data

Dec. 1, 2014 (JP) ..... 2014-243512

(51) Int. Cl.
*F01D 25/26* (2006.01)
*F01D 25/28* (2006.01)
*F01D 25/24* (2006.01)

(52) U.S. Cl.
CPC ..... *F01D 25/26* (2013.01); *F01D 25/243* (2013.01); *F01D 25/265* (2013.01); *F01D 25/28* (2013.01); *F05D 2220/31* (2013.01)

(58) Field of Classification Search
None
See application file for complete search history.

(56) References Cited

U.S. PATENT DOCUMENTS 2,388,345 A * 11/1945 Skaggs ..... F22B 27/16 122/41
3,592,557 A 7/1971 Haas et al.
(Continued)

FOREIGN PATENT DOCUMENTS

JP 27-2051 6/1952
JP 49-97106 9/1974
(Continued)

OTHER PUBLICATIONS

Notification of Reasons for Refusal dated May 25, 2017 in corresponding Japanese Application No. 2014-243512, with English Translation.

(Continued)

*Primary Examiner* — Christopher Verdier
*Assistant Examiner* — Juan G Flores
(74) *Attorney, Agent, or Firm* — Wenderoth, Lind & Ponack, L.L.P.

(57) ABSTRACT

A steam turbine casing includes a lower half part having a plurality of lower support portions projecting horizontally around a lower half part body; an upper half part connected onto the lower half part; a support member fixed to an upper surface part of a respective one of the lower support portions; and a plurality of support columns each having a lower end part on a frame and an upper end part to which a lower surface part of the support member fixed to a corresponding one of the lower support portions. Thus, thermal deformation of the casing is suppressed, and a suitable clearance can be maintained between the casing and a turbine.

8 Claims, 9 Drawing Sheets

(56) References Cited

U.S. PATENT DOCUMENTS

| | | | | |
|---|---|---|---|---|
| 3,764,098 | A | 10/1973 | Dickinson | |
| 3,937,433 | A * | 2/1976 | Portaleoni | F01D 25/28 248/550 |
| 5,290,146 | A | 3/1994 | Erber | |
| 8,821,110 | B2 | 9/2014 | Predmore et al. | |
| 9,157,335 | B2 * | 10/2015 | Kundram | F01D 25/28 |

FOREIGN PATENT DOCUMENTS

| | | |
|---|---|---|
| JP | 52-114102 | 8/1977 |
| JP | 63-63506 | 4/1988 |
| JP | 3448166 | 9/2003 |
| JP | 2004-150357 | 5/2004 |
| JP | 2007-9731 | 1/2007 |
| JP | 4410651 | 2/2010 |
| JP | 5047130 | 10/2012 |
| JP | 5159702 | 3/2013 |

OTHER PUBLICATIONS

International Search Report dated Feb. 23, 2016 in corresponding International (PCT) Application No. PCT/JP2015/082910.
Written Opinion dated Feb. 23, 2016 in corresponding International (PCT) Application No. PCT/JP2015/082910.
Notification of Reason for Refusal dated May 17, 2018 in Korean Patent Application No. 10-2017-7014698, with English Translation.

* cited by examiner

STEAM TURBINE CASING

CROSS-REFERENCE TO RELATED APPLICATION

This application is a national stage of PCT International Application No. PCT/JP2015/082910, filed on Nov. 24, 2015, which claims priority to and incorporates by reference the entire contents of Japanese Patent Application No. 2014-243512 filed in Japan on Dec. 1, 2014.

FIELD

The present disclosure relates to a steam turbine casing that accommodates therein a turbine rotatably, and in particular, to a support structure of the casing.

BACKGROUND

A general steam turbine is configured such that a rotor, which is a rotating shaft, is supported rotatably by a casing, turbine blades are provided on an outer peripheral portion of this rotor, turbine vanes are provided on the casing, and multiple stages of these blades and vanes are alternately arranged in a steam passage. Therefore, when steam flows in the steam passage, flow of this steam is regulated by the turbine vanes, and the rotor is able to be driven and rotated via the turbine blades.

In such a steam turbine, the casing is formed of an upper casing and a lower casing. Four curved legged portions are provided around the lower casing, and the lower casing is supported by respective curved legged bases erected on a frame. The upper casing is placed on the lower casing, and connected to the lower casing by bolts. Temperature of the casing of the steam turbine changes upon startup, upon operation, and upon stoppage, and the temperature differs depending on positions thereof. For example, by collection of high temperature air at an upper portion of the casing due to flow of air inside the casing, the upper casing tends to become higher in temperature than the lower casing. The upper casing and the lower casing then undergo different thermal deformations, and thus a clearance between the casing and the turbine may become small.

As means for solving this problem, for example, those described in the following patent literatures are available. In a turbine described in Japanese Patent No. 4410651, a main body portion of the lower casing is covered by a heat insulating material such that it becomes difficult for the main body portion of the lower casing to radiate heat compared to an upper half ground portion. Further, in a steam turbine described in Japanese Patent No. 5159702, height of an upper half casing with respect to a bearing stand is adjusted based on a temperature of the casing. Furthermore, as to bolts for pressing a casing of a steam turbine described in Japanese unexamined Utility Model Application Publication No. 63-063506, an upper half casing and a lower half casing are placed in a bearing box and fastened by hold-down bolts.

According to the above described Japanese Patent No. 4410651 and Japanese Patent No. 5159702, since the heat insulating material or a device for adjusting the height is provided, the structure becomes complicated, and manufacturing cost is also increased. Further, according to Japanese Unexamined Utility Model Application Publication No. 63-063506, when the lower half casing undergoes thermal expansion, the upper half casing is deformed upward, and thus the shaft centers of the casing and the turbine are shifted from each other, and the lower clearance between the casing and the turbine becomes small.

SUMMARY

The present disclosure solves the above described problems, and an object thereof is to provide a steam turbine casing that enables a proper clearance to be maintained between the casing and a turbine by reduction of thermal deformation of the casing.

Solution to Problem

According to the present invention, there is provided a steam turbine casing having a lower half portion in which multiple lower support portions protruding in a horizontal direction around a lower half portion main body thereof are provided, an upper half portion connected onto the lower half portion, multiple support members each of which is fixed to an upper surface portion of each of the multiple lower support portions, and multiple support columns each of which has a lower end portion arranged on a frame and an upper end portion to which a lower surface portion of each of the multiple support members is fixed.

Therefore, since the upper half portion is connected onto the lower half portion, the support member is fixed to the upper surface portion of the lower support portion and the lower surface portion of the support member is fixed to the upper end portion of the support column arranged on the frame, the lower half portion is supported on a center line of the casing via the support member, the center line corresponding to an connection surface between the upper half portion and the lower half portion. Accordingly, upon thermal expansion, the upper half portion and the lower half portion are thermally deformed upward and downward with the center line of the casing as a starting point, and thus a vertical direction shift between the center of the casing and the center of the turbine accommodated inside the casing is reduced. As a result, thermal deformation of the casing is able to be reduced and a proper clearance is able to be maintained between the casing and the turbine.

According to the present disclosure, a steam turbine casing, having a lower half portion in which multiple lower support portions protruding in a horizontal direction around a lower half portion main body thereof are provided, an upper half portion that is connected onto the lower half portion and in which multiple upper support portions protruding in the horizontal direction around an upper half portion main body thereof are provided, multiple upper support columns each of which has a lower end portion arranged on a frame and an upper end portion to which a lower surface portion of each of the multiple upper support portions is fixed, and multiple lower support columns each of which has a lower end portion arranged on a frame and an upper end portion to which a lower surface portion of each of the multiple lower support portions is fixed, wherein a vertical direction thickness of each of the multiple lower support portions is set to be thinner than a vertical direction thickness of each of the multiple lower support portions.

Therefore, the upper half portion is connected onto the lower half portion, the lower surface portion of the upper support portion is fixed to the upper end portion of the upper support column arranged on the frame, and the lower surface portion of the lower support portion is fixed to the upper end portion of the lower support column arranged on the frame. As a result, the upper support portion is supported on the center line of the casing, the center line corresponding to an connection surface between the upper half portion and the lower half portion, the lower support portion is supported below the center line of the casing, and the thickness of the lower support portion is thinner than the thickness of the lower support portion. Accordingly, upon thermal expansion of the upper half portion and the lower half portion, thermal deformation of the lower support portion is small and the upper half portion and the lower half portion are thermally deformed upward and downward with the center line of the casing as a starting point, and as this happens, the vertical direction shift between the center of the casing and the center of the turbine accommodated inside the casing is reduced. As a result, thermal deformation of the casing is able to be reduced and a proper clearance is able to be maintained between the casing and the turbine.

BRIEF DESCRIPTION OF THE DRAWINGS

The above and other objects, features, advantages and technical and industrial significance of this disclosure will be better understood by reading the following detailed description of presently preferred embodiments of the disclosure, when considered in connection with the accompanying drawings.

DETAILED DESCRIPTION OF THE PREFERRED EMBODIMENT

Hereinafter, preferred embodiments of a steam turbine casing according to the present disclosure will be described in detail, by reference to the appended drawings. The present disclosure is not limited by these embodiments, and when there are multiple embodiments, the present disclosure includes those configured of combinations of the respective embodiments.

First Embodiment

Figure 3:
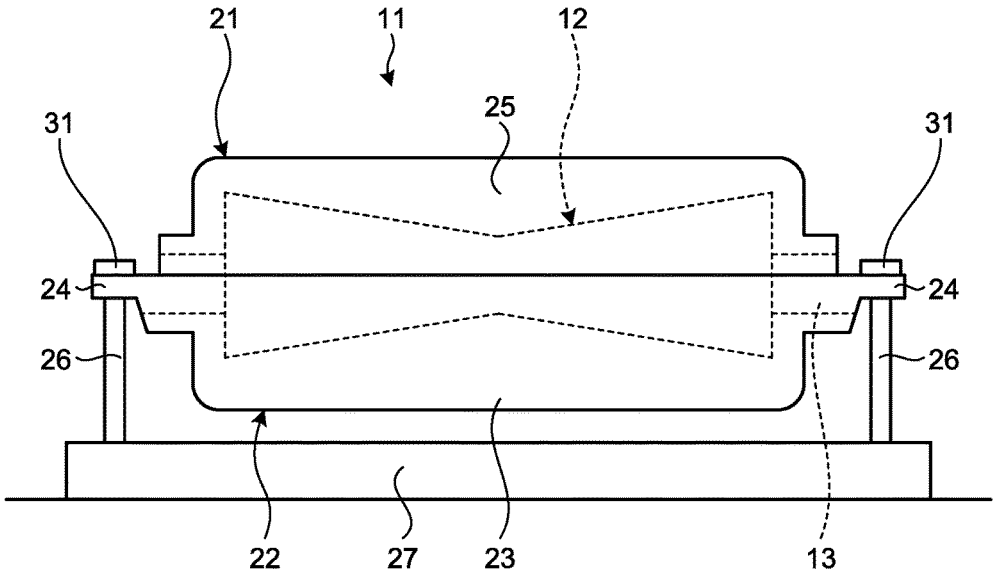
FIG. 3 is a front view of the steam turbine casing.
Figure 4:
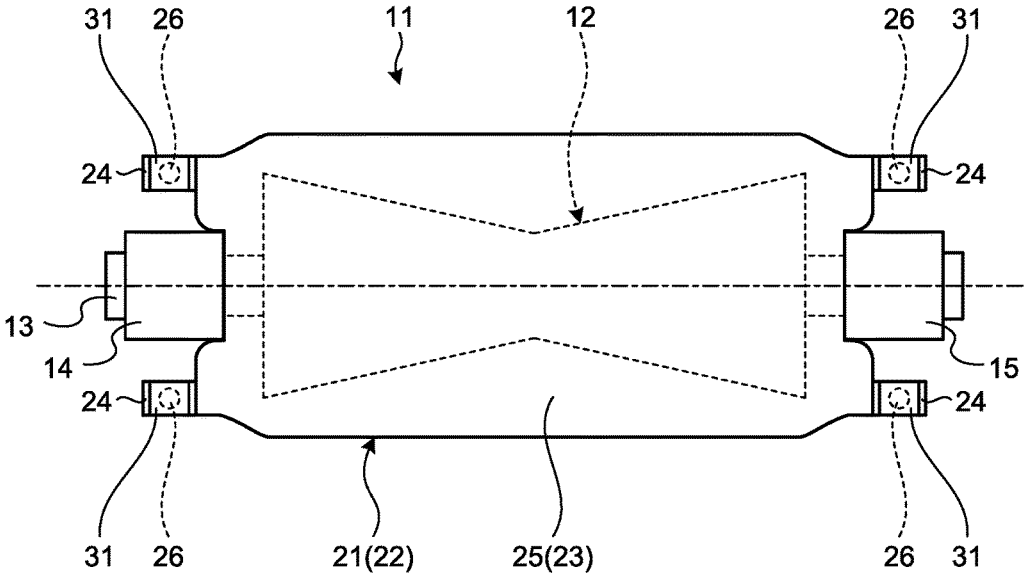
FIG. 4 is a plan view of the steam turbine casing.

FIG. 3 is a front view of a steam turbine casing, and FIG. 4 is a plan view of the steam turbine casing.

In the first embodiment, as illustrated in FIG. 3 and FIG. 4, a steam turbine casing (hereinafter, referred to as "casing") 11 is manufactured in a cylindrical shape with cast iron, a hollow portion is formed inside the steam turbine casing 11 by both axial direction end portions thereof being closed, and a turbine 12 is accommodated in this hollow portion. This turbine 12 has multiple stages of turbine blades (illustration thereof being omitted) provided on an outer peripheral portion of a rotor (rotating shaft) 13. Further, the casing 11 has multiple stages of turbine vanes (illustration thereof being omitted) provided on an inner peripheral portion thereof. The respective turbine blades of the turbine 12 and the respective turbine vanes of the casing 11 are alternately arranged at predetermined intervals in an axial direction of the rotor 13.

Further, respective axial direction end portions of the rotor 13 protrude outward from the casing 11, and are supported rotatably by bearings 14 and 15. Therefore, when steam is supplied into the casing 11, by this steam acting on the respective turbine vanes and the respective turbine blades, the rotor is able to be rotated via the respective turbine blades.

The casing 11 has an upper half portion 21 and a lower half portion 22. The lower half portion 22 has a lower half portion main body 23, and four curved legged portions (lower support portions) 24. The lower half portion main body 23 is formed in a shape resulting from a cylinder being cut into half parallelly to the rotor 13. Each of the curved legged portions 24 is formed to protrude horizontally outward from an outer periphery of the lower half portion main body 23. That is, the lower half portion main body 23 is rectangular in a plan view thereof, has the respective curved legged portions 24 formed at both shaft end sides of the rotor 13, and each of these curved legged portions 24 protrudes along the axial direction of the rotor 13.

The upper half portion 21 has an upper half portion main body 25. The upper half portion main body 25 is formed in a shape resulting from a cylinder being cut into half parallelly to the rotor 13. The lower half portion 22 is arranged such that inside of the lower half portion main body 23 faces upward in a vertical direction, the upper half portion main body 25 of the upper half portion is placed on the lower half portion main body 23 such that inside of the upper half portion main body 25 faces downward in the vertical direction, and the upper half portion main body 25 is connected thereto by bolts not illustrated.

Further, the casing 11 has four curved leg bases (support columns) 26. Each of the curved leg bases 26 is formed in a column shape (or prism shape), and provided to erect along the vertical direction. That is, a lower end portion of each of the curved leg bases 26 is fixed to a predetermined position on a frame 27, and the respective curved legged portions 24 in the lower half portion 22 are supported by upper end portions of the respective curved leg bases 26.

Figure 1:
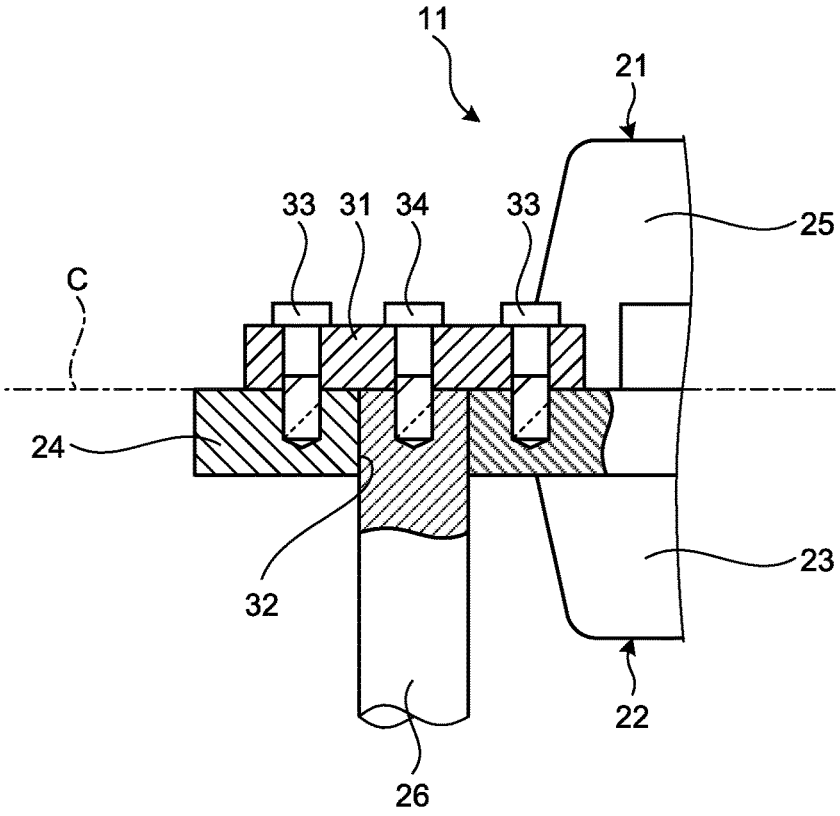
FIG. 1 is a longitudinal sectional view illustrating a support structure of a steam turbine casing according to a first embodiment.
Figure 2:
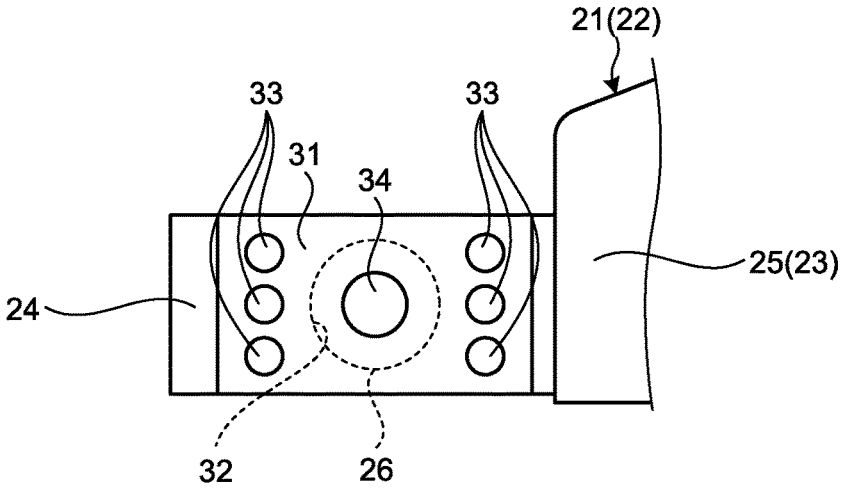
FIG. 2 is a plan view illustrating the support structure of the steam turbine casing.

A support structure of the casing 11 will now be described in detail. FIG. 1 is a longitudinal sectional view illustrating the support structure of the steam turbine casing of the first embodiment, and FIG. 2 is a plan view illustrating the support structure of the steam turbine casing.

In addition to the upper half portion 21, the lower half portion 22, and the curved leg bases 26, the casing 11 has cover members (support members) 31 that are fixed to upper surface portions of the curved legged portions (lower support portions) 24 in the lower half portion 22.

That is, the curved legged portion 24 is a flat plate shaped member with its upper surface portion and lower surface portion being parallel to each other, the flat plate shaped member forming a horizontal rectangular shape, and one of its longitudinal end portions is integrally coupled to the lower half portion main body 23. The curved legged portion 24 has a through hole 32 formed therein, which extends along the vertical direction. This through hole 32 is circular, and an inner diameter thereof is set to be a little larger than an outer diameter of the curved leg base 26. Similarly to the curved legged portion 24, the cover member 31 is a flat plate shaped member with its upper surface and lower surface being parallel to each other, the flat plate shaped member forming a horizontal rectangular shape, with a width that is the same as that of the curved legged portion 24, and formed to be shorter than the curved legged portion 24, and a length of each of lengthwise and crosswise sides of the cover member 31 is larger than the inner diameter of the through hole 32. The width of the cover member 31 may also not be the same as that of the curved legged portion 24.

The cover member 31 is in close contact with the upper surface portion of the curved legged portion 24 so as to cover the through hole 32 over the curved legged portion 24. The cover member 31 is fixed to the curved legged portion 24 by a plurality of (six, in this embodiment) fixing bolts 33 penetrating through the cover member 31 from thereabove and being screwed into the curved legged portion 24, around the through hole 32. Further, the upper end portion of each of the curved leg bases 26 is inserted into the through hole 32 of the curved legged portion 24 from therebelow, and an upper end surface of each of the curved leg bases 26 is in close contact with the lower surface portion of the cover member 31. The cover member 31 is fixed to the curved leg base 26 by a fixing bolt 34 penetrating through the cover member 31 from thereabove at a position corresponding to the through hole 32 and being screwed into the respective curved leg base (support column) 26.

Accordingly, the upper half portion 21 is connected onto the lower half portion 22, the cover members 31 are fixed to the upper surface portions of the respective curved legged portions 24, and the upper end portions of the curved leg bases 26 arranged on the frame 27 are inserted into the through holes 32 and fixed to the lower surface portions of the cover members 31. The upper half portion 21 and the lower half portion 22 are supported by the curved leg bases 26 via the cover members 31, on a center line C of the casing 11, the center line C corresponding to an connection surface between the upper half portion 21 and the lower half portion 22. Therefore, when the casing 11 undergoes thermal expansion, the upper half portion 21 is thermally deformed upward with the center line C of the casing 11 as a starting point, and the lower half portion 22 is thermally deformed downward with the center line C of the casing 11 as a starting point, and thus a vertical direction shift between a center of the casing 11 and a center of the turbine 12 accommodated inside the casing 11 is reduced.

As described above, in the steam turbine casing of the first embodiment, the lower half portion 22, in which the multiple curved legged portions 24 protruding in the horizontal direction around the lower half portion main body 23 are provided; the upper half portion 21 connected onto the lower half portion 22, the cover members 31 fixed to the upper surface portions of the curved legged portions 24, and the curved leg bases 26 having the lower end portions arranged on the frame 27 and the upper end portions, to which the lower surface portions of the cover members 31 are fixed, are provided.

Therefore, since the lower half portion 22 is supported via the cover members 31, on the center line C of the casing 11, the center line C corresponding to the connection surface between the upper half portion 21 and the lower half portion 22, upon thermal expansion, the upper half portion 21 and the lower half portion 22 are thermally deformed upward and downward with the center line C of the casing 11 as a starting point. Thus, the vertical direction shift between the center of the casing 11 and the center of the turbine 12 accommodated inside the casing 11 is reduced. As a result, thermal deformation of the casing 11 is able to be reduced and a proper clearance is able to be maintained between the casing 11 and the turbine 12.

In the steam turbine casing of the first embodiment, the curved legged portions 24 have the through holes 32 extending in the vertical direction provided therein, the upper end portions of the curved leg bases (support columns) 26 are inserted into the through holes 32, and the upper end surfaces of the curved leg bases 26 are in close contact with and fixed to the lower surface portion of a respective one of the cover members (support members) 31. Therefore, sufficient stiffness of the curved legged portions 24 can be obtained.

In the steam turbine casing of the first embodiment, the cover members 31 are fixed to the upper surface portions of the curved legged portions 24 of the lower half portion 22, and the upper end portions of the curved leg bases 26 are fixed to the cover members 31. Therefore, without change in the structure of the upper half portion 21, strong coupling between the curved leg bases 26 and the lower half portion 22 is enabled easily.

Second Embodiment

Figure 5:
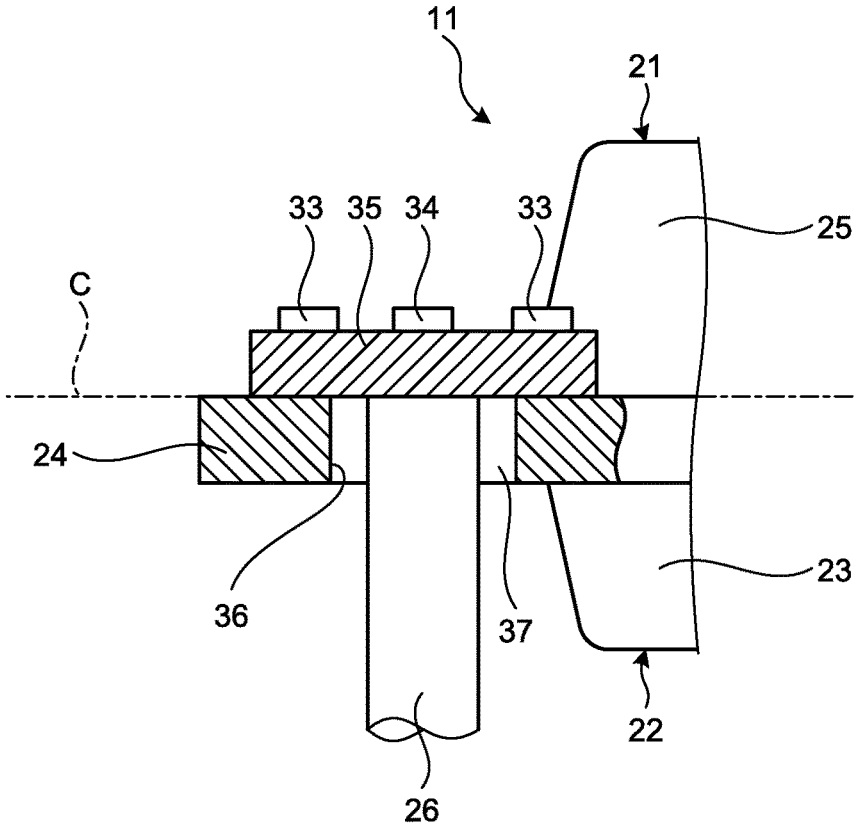
FIG. 5 is a longitudinal sectional view illustrating a support structure of a steam turbine casing according to a second embodiment.
Figure 6:
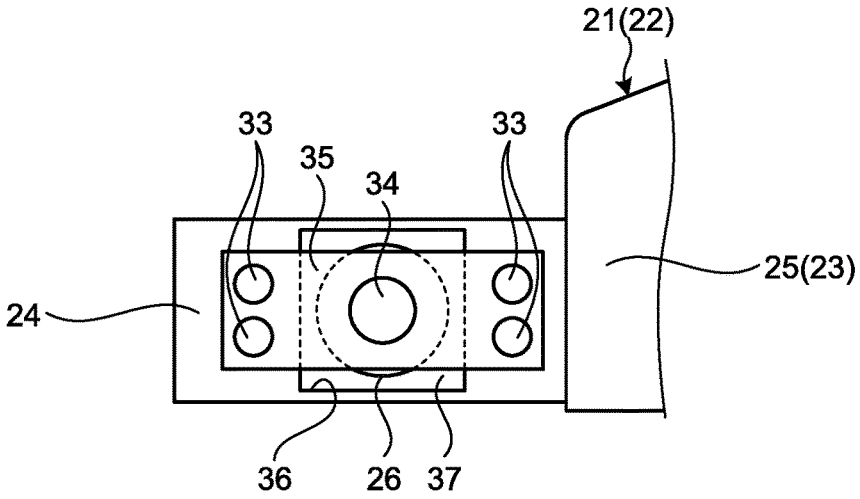
FIG. 6 is a plan view illustrating the support structure of the steam turbine casing.

FIG. 5 is a longitudinal sectional view illustrating a support structure of a steam turbine casing of a second embodiment, and FIG. 6 is a plan view illustrating the support structure of the steam turbine casing. The same signs will be appended to parts having functions that are the same as those of the above described embodiment, and detailed description thereof will be omitted.

In the second embodiment, as illustrated in FIG. 5 and FIG. 6, the casing 11 has the upper half portion 21, the lower half portion 22, the curved leg bases 26, and cover members 35.

The curved legged portion 24 is a flat plate shaped member forming a horizontal rectangular shape, one of longitudinal end portions of the curved legged portion 24 is integrally coupled to the lower half portion main body 23, and a through hole 36 along the vertical direction is formed in the curved legged portion 24. This through hole 36 is quadrilateral, and a length of each of lengthwise and crosswise sides of the through hole 36 is set to be larger than the outer diameter of the curved leg base 26. The cover member 35 is a flat plate shaped member having a horizontal rectangular shape, and is formed such that a length of the cover member 35 is longer than a length of the through hole 36, and a width of the cover member 35 is shorter than a width of the through hole 36.

The cover member 35 is in close contact with the upper surface portion of the curved legged portion 24 so as to cover a part of the through hole 36 over the curved legged portion 24. The cover member 35 is fixed to the curved legged portion 24 by the multiple fixing bolts 33 penetrating through the cover member 35 from above the cover member 35 and being screwed into the curved legged portion 24, around the through hole 36. Further, the upper end portion of each of the curved leg bases 26 is inserted into the through hole 36 of the curved legged portion 24 from therebelow, and an upper end surface of each of the curved leg bases 26 is in close contact with the lower surface portion of the cover member 35. The cover member 35 is fixed to the curved leg base 26 by the fixing bolt 34 penetrating through the cover member 35 from above the cover member 35, and being screwed into the curved leg base 26.

In this embodiment, a gap 37 is provided between the through hole 36 and the curved leg base 26, and the through hole 36 is open toward the cover member 35. That is, by the cover member 35 covering an intermediate portion of the through hole 36 in a width direction, both side portions of the through hole 36 are open. Thus, the gap 37 provided between an inner peripheral surface of the through hole 36 and an outer peripheral surface of the curved leg base 26 is open upward and downward.

Accordingly, the upper half portion 21 is connected onto the lower half portion 22, the cover members 35 are fixed to the upper surface portions of the respective curved legged portions 24, and the upper end portions of the curved leg bases 26 arranged on the frame 27 are inserted into the through holes 36 and fixed to the lower surface portions of the cover members 35. The upper half portion 21 and the lower half portion 22 are supported by the curved leg bases 26 via the cover members 35, on the center line C of the casing 11, the center line C corresponding to the connection surface between the upper half portion 21 and the lower half portion 22. Therefore, when the casing 11 undergoes thermal expansion, the upper half portion 21 is thermally deformed upward with the center line C of the casing 11 as a starting point, and the lower half portion 22 is thermally deformed downward with the center line C of the casing 11 as a starting point, and thus the vertical direction shift between the center of the casing 11 and the center of the turbine 12 accommodated inside the casing 11 is reduced. Further, since the gap 37 is provided between the through hole 36 and the curved leg base 26, heat in the curved legged portion 24 escapes upward through the gap 37 by natural convection, and thus temperature increase of the lower half portion 22 is able to be reduced.

As described above, in the steam turbine casing of the second embodiment, the through hole 36 is formed in the curved legged portion 24 of the lower half portion 22, the cover member 35 is fixed to the upper surface portion of the curved legged portion 24 so as to cover a part of the through hole 36, the upper end portion of the curved leg base 26 is inserted into the through hole 36 and fixed to the lower surface portion of the cover member 31, the gap 37 is provided between the through hole 36 and the curved leg base 26, and the through hole 36 is open upward in the cover member 35.

Therefore, by the provision of the gap 37 between the through hole 36 and the curved leg base 26, the natural convection is caused in this gap 37 by heat in the curved legged portion 24, and the heat in the curved legged portion 24 escapes upward through the gap 37, and thus the temperature increase of the lower half portion 22 is able to be reduced and thermal deformation of the curved legged portion 24 is able to be reduced.

Third Embodiment

Figure 7:
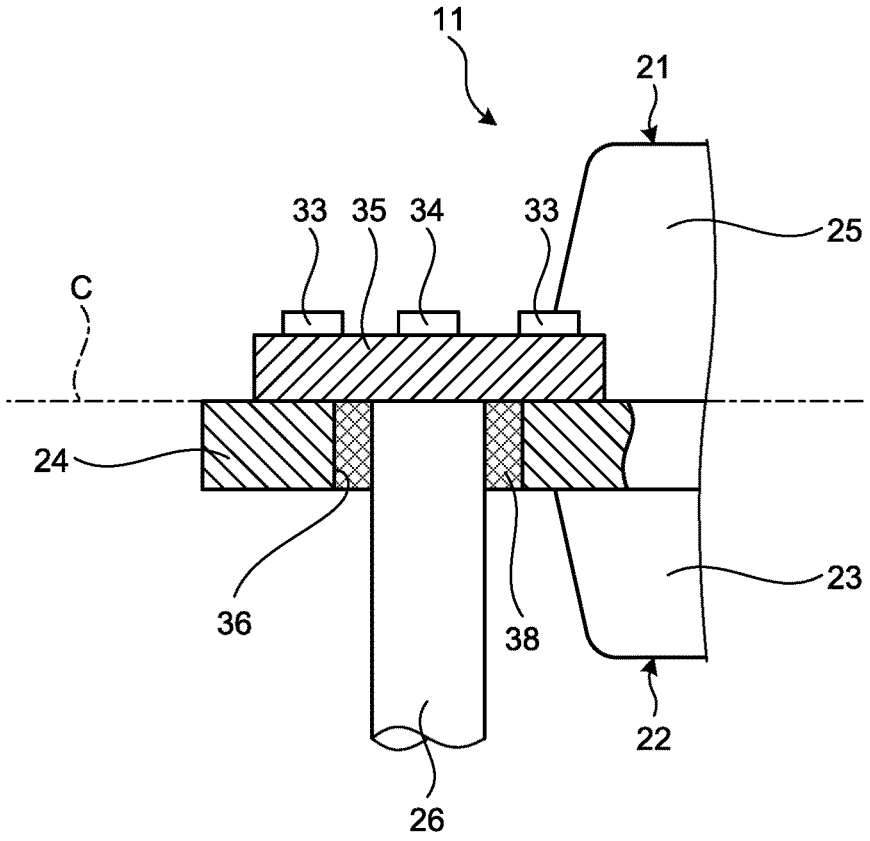
FIG. 7 is a longitudinal sectional view illustrating a support structure of a steam turbine casing according to a third embodiment.
Figure 8:
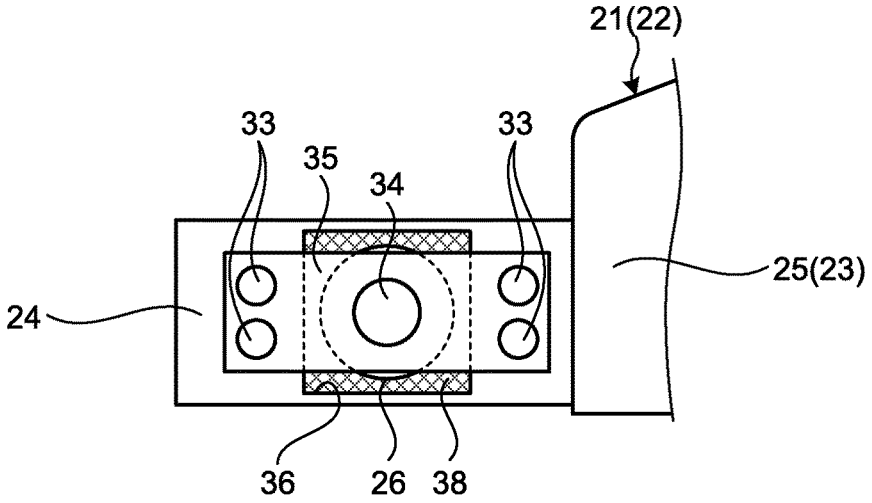
FIG. 8 is a plan view illustrating the support structure of the steam turbine casing.

FIG. 7 is a longitudinal sectional view illustrating a support structure of a steam turbine casing of a third embodiment, and FIG. 8 is a plan view illustrating the support structure of the steam turbine casing. The same signs will be appended to parts having functions that are the same as those of the above described embodiments, and detailed description thereof will be omitted.

In the third embodiment, as illustrated in FIG. 7 and FIG. 8, the casing 11 has the upper half portion 21, the lower half portion 22, the curved leg bases 26, and the cover members 35.

The curved legged portion 24 is a flat plate shaped member having a horizontal rectangular shape, one of longitudinal end portions of the curved legged portion 24 is integrally coupled to the lower half portion main body 23, and a through hole 36 along the vertical direction is formed in the curved legged portion 24. The cover member 35 is a flat plate shaped member having a horizontal rectangular shape. The cover member 35 is in close contact with the upper surface portion of the curved legged portion 24 so as to cover a part of the through hole 36 over the curved legged portion 24, and is fixed thereto by the multiple fixing bolts 33. Further, the upper end portion of each of the curved leg bases 26 is inserted into the through hole 36 of the curved legged portion 24 from therebelow, an upper end surface of the curved leg base 26 is in close contact with the lower surface portion of the cover member 35, and the curved leg base 26 is fixed by the fixing bolt 34.

In this embodiment, the gap 37 is provided between the through hole 36 and the curved leg base 26, and the through hole 36 is open toward the cover member 35. A heat insulating material 38 is provided between the inner peripheral surface of the through hole 36 and the outer peripheral surface of the curved leg base 26, that is, in this gap 37. In this case, the cover member 35 may be not open upward.

Accordingly, the upper half portion 21 is connected onto the lower half portion 22, the cover members 35 are fixed to the upper surface portions of the respective curved legged portions 24, and the upper end portions of the curved leg bases 26 arranged on the frame 27 are inserted into the through holes 36 and fixed to the lower surface portions of the cover members 35. The upper half portion 21 and the lower half portion 22 are supported by the curved leg bases 26 via the cover members 35, on the center line C of the casing 11, the center line C corresponding to the connection surface between the upper half portion 21 and the lower half portion 22. Therefore, when the casing 11 undergoes thermal expansion, the upper half portion 21 is thermally deformed upward with the center line C of the casing 11 as a starting point, and the lower half portion 22 is thermally deformed downward with the center line C of the casing 11 as a starting point, and thus the vertical direction shift between the center of the casing 11 and the center of the turbine 12 accommodated inside the casing 11 is reduced. Further, since the heat insulating material 38 is provided between the through hole 36 and the curved leg base 26, heat in the curved legged portion 24 is not transferred to the curved leg base 26 and the temperature increase of the curved legged base 26 is able to be reduced.

As described above, in the steam turbine casing of the third embodiment, the through hole 36 is formed in the curved legged portion 24 of the lower half portion 22, the cover member 35 is fixed to the upper surface portion of the curved legged portion 24 so as to cover a part of the through hole 36, the upper end portion of the curved leg base 26 is inserted into the through hole 36 and fixed to the lower surface portion of the cover member 31, and the heat insulating material 38 is provided between the through hole 36 and the curved leg base 26.

Therefore, by the provision of the heat insulating material 38 between the through hole 36 and the curved leg base 26; heat in the curved legged portion 24 is blocked by the heat insulating material 38 and becomes difficult to be transferred to the curved leg base 26, and temperature increase of the curved legged base 26 is able to be reduced.

Fourth Embodiment

Figure 9:
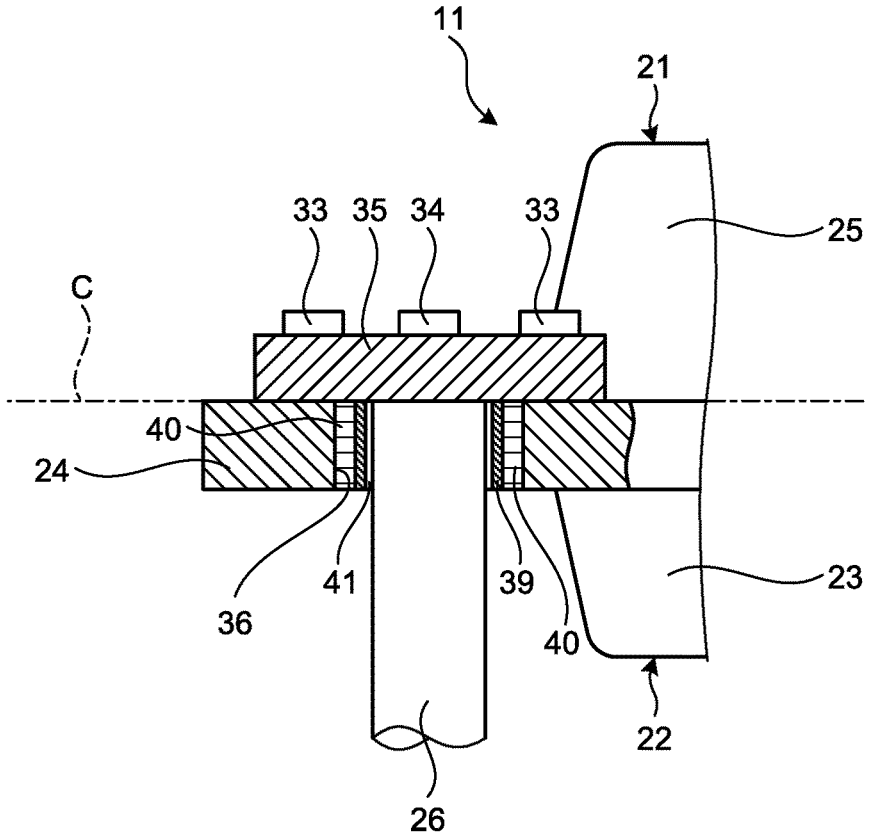
FIG. 9 is a longitudinal sectional view illustrating a support structure of a steam turbine casing according to a fourth embodiment.
Figure 10:
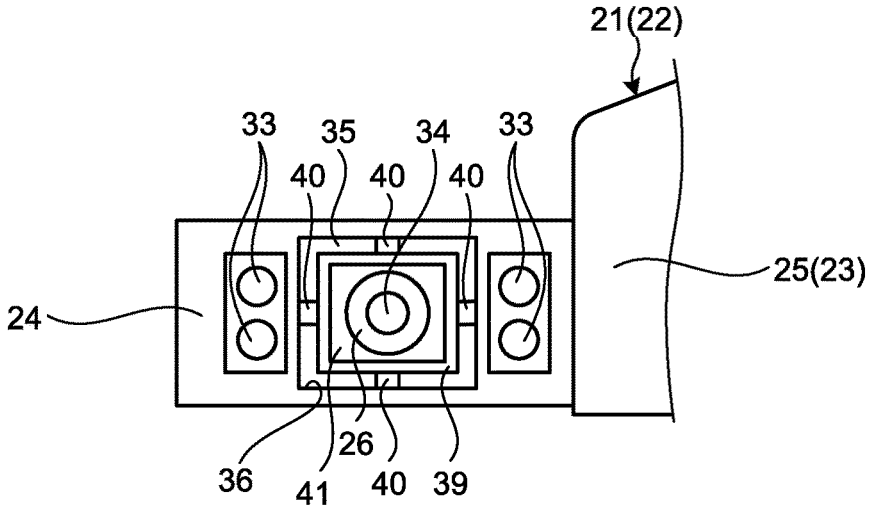
FIG. 10 is a plan view illustrating the support structure of the steam turbine casing.

FIG. 9 is a longitudinal sectional view illustrating a support structure of a steam turbine casing of a fourth embodiment, and FIG. 10 is a plan view illustrating the support structure of the steam turbine casing. The same signs will be appended to parts having functions that are the same as those of the above described embodiments, and detailed description thereof will be omitted.

In the fourth embodiment, as illustrated in FIG. 9 and FIG. 10, the casing 11 has the upper half portion 21, the lower half portion 22, the curved leg bases 26, and the cover members 35.

The curved legged portion 24 is a flat plate shaped member having a horizontal rectangular shape, one of longitudinal end portions of the curved legged portion 24 is integrally coupled to the lower half portion main body 23, and a through hole 36 along the vertical direction is formed in the curved legged portion 24. The cover member 35 is a flat plate shaped member having a horizontal rectangular shape. The cover member 35 is in close contact with the upper surface portion of the curved legged portion 24 so as to cover a part of the through hole 36 over the curved legged portion 24, and is fixed by the multiple fixing bolts 33. Further, the upper end portions of the respective curved leg bases 26 are inserted into the through holes 36 of the curved legged portions 24 from therebelow, and upper end surfaces of the curved leg bases 26 are in close contact with to the lower surface portions of the cover members 35 and fixed by the fixing bolts 34.

In this embodiment, the gap 37 is provided between the through hole 36 and the curved leg base 26, and the through hole 36 is open toward the cover member 35. A heat shielding material 39 is provided between the inner peripheral surface of the through hole 36 and the outer peripheral surface of the curved leg base 26, that is, in this gap 37. This heat shielding material 39 has a quadrangular cylinder shape, is arranged between the inner peripheral surface of the through hole 36 and the outer peripheral surface of the curved leg base 26, and an outer peripheral portion of the heat shielding material 39 is fixed to the inner peripheral surface of the through hole 36 by fixed metal fittings 40. A gap 41 is kept between the heat shielding material 39 and the outer peripheral surface of the curved leg base 26.

Accordingly, the upper half portion 21 is connected onto the lower half portion 22, the cover members 35 are fixed to the upper surface portions of the respective curved legged portions 24, and the upper end portions of the curved leg bases 26 arranged on the frame 27 are inserted into the through holes 36 and fixed to the lower surface portions of the cover members 35. The upper half portion 21 and the lower half portion 22 are supported by the curved leg bases 26 via the cover members 35, on the center line C of the casing 11, the center line C corresponding to the connection surface between the upper half portion 21 and the lower half portion 22. Therefore, when the casing 11 undergoes thermal expansion, the upper half portion 21 is thermally deformed upward with the center line C of the casing 11 as a starting point, and the lower half portion 22 is thermally deformed downward with the center line C of the casing 11 as a starting point, and thus the vertical direction shift between the center of the casing 11 and the center of the turbine 12 accommodated inside the casing 11 is reduced. Further, since the heat shielding material 39 is provided between the through hole 36 and the curved leg base 26, the temperature increase of curved legged base 26 is able to be reduced without transfer of radiant heat in the curved legged portion 24 to the curved legged base 26.

As described above, in the steam turbine casing of the fourth embodiment, the through hole 36 is formed in the curved legged portion 24 of the lower half portion 22, the cover member 35 is fixed to the upper surface portion of the curved legged portion 24 so as to cover a part of the through hole 36, the upper end portion of the curved leg base 26 is inserted into the through hole 36 and fixed to the lower surface portion of the cover member 35, and the heat shielding material 39 is provided between the through hole 36 and the curved leg base 26.

Therefore, by the provision of the heat shielding material 39 between the through hole 36 and the curved leg base 26, radiant heat in the curved legged portion 24 is blocked by the heat shielding material 39 and will not heat up the curved legged base 26, and thus the temperature increase of the curved legged base 26 is able to be reduced and thermal deformation of the curved legged base 26 is able to be reduced.

Fifth Embodiment

Figure 11:
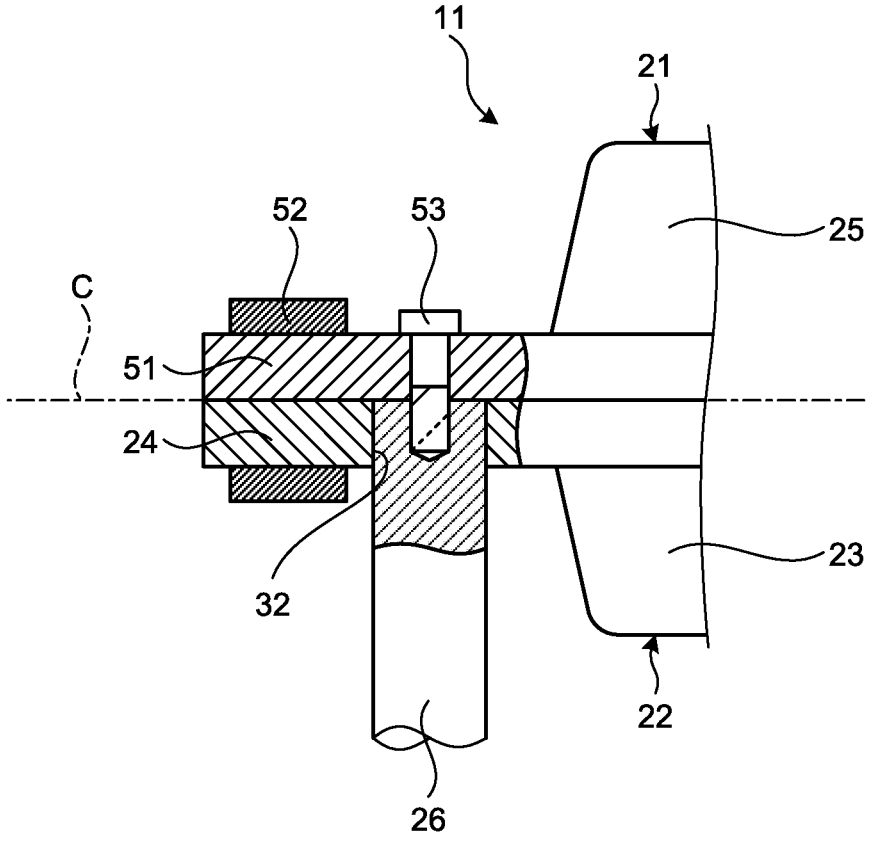
FIG. 11 is a longitudinal sectional view illustrating a support structure of a steam turbine casing according to a fifth embodiment.
Figure 12:
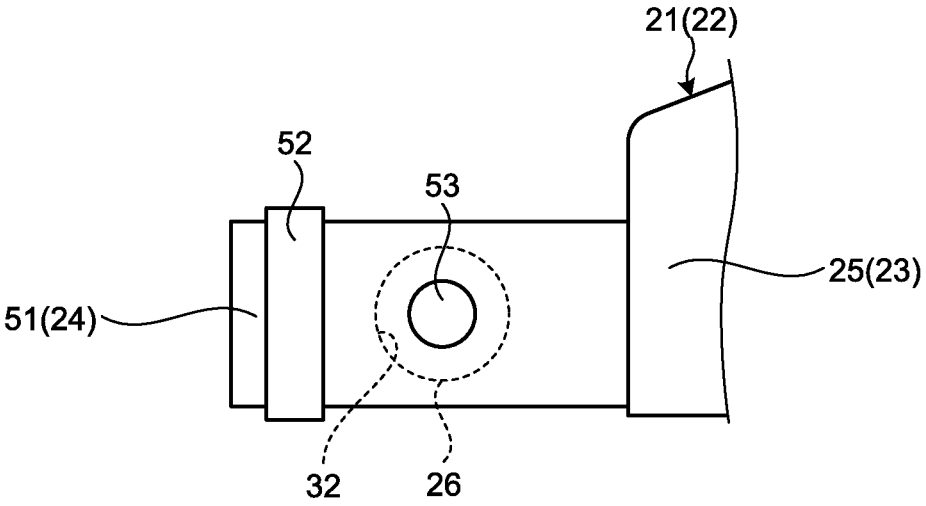
FIG. 12 is a plan view illustrating the support structure of the steam turbine casing.

FIG. 11 is a longitudinal sectional view illustrating a support structure of a steam turbine casing of a fifth embodiment, and FIG. 12 is a plan view illustrating the support structure of the steam turbine casing. The same signs will be appended to parts having functions that are the same as those of the above described embodiments, and detailed description thereof will be omitted.

In the fifth embodiment, as illustrated in FIG. 11 and FIG. 12, the casing 11 has the upper half portion 21, the lower half portion 22, and the curved leg bases 26.

The upper half portion 21 has the upper half portion main body 25, and four curved legged portions (upper support portions) 51. Each of the curved legged portions 51 is formed to protrude horizontally outward from an outer periphery of the upper half portion main body 25. That is, the upper half portion main body 25 is rectangular in a plan view thereof, has the respective curved legged portions 51 formed at both shaft end sides of the rotor 13, and each of these curved legged portions 51 protrudes along the axial direction of the rotor 13. The upper half portion 21 and the lower half portion 22 have the same shape in a plan view thereof, the upper half portion 21 is placed on the lower half portion 22, and the upper half portion 21 and the lower half portion 22 are connected to each other by bolts not illustrated.

Further, the casing 11 has the four curved leg bases 26. Each of the curved leg bases 26 is formed in a column shape (or prism shape), and provided to erect along the vertical direction. That is, the lower end portion of each of the curved leg bases 26 is fixed to a predetermined position on the frame 27, and the curved legged portions 51 in the upper half portion 21 and the respective curved legged portions 24 in the lower half portion 22 are supported by the upper end portions of the respective curved leg bases 26.

The respective curved legged portions 51 and 24 have substantially the same shape and same dimensions, and one of longitudinal end portions of the respective curved legged portions 51 is integrally coupled to the upper half portion main body 25 and one of longitudinal end portions of the respective curved legged portions 24 is integrally coupled to the lower half portion main body 23. The curved legged portion 24 of the lower half portion 22 has the through hole 32 formed therein, which is along the vertical direction. The curved legged portions (support members) 51 of the upper half portion 21 are in close contact with the upper surface portions of the curved legged portions 24 so as to cover the through holes 32 over the curved legged portions 24 of the lower half portion 22. The curved legged portions 51 and 24 are fixed by a shrink band (connection member) 52 at distal end portions of the curved legged portions 51 and 24. Further, the upper end portions of the respective curved leg bases 26 are inserted into the through holes 32 of the curved legged portions 24 from therebelow, and the upper end surfaces of the respective curved leg bases 26 are in close contact with the lower surface portions of the curved legged portions 51. The curved legged portion 51 is fixed to the curved leg base 26 by a fixing bolt 53 penetrating through the curved legged portion 51 from thereabove at a position corresponding to the through hole 32 and being screwed into the curved leg base 26.

Accordingly, the upper half portion 21 is connected onto the lower half portion 22, the respective curved legged portions 51 and 24 are fixed together, and the upper end portions of the curved leg bases 26 arranged on the frame 27 are inserted into the through holes 32 and fixed to the lower surface portions of the curved legged portions 51. The upper half portion 21 and the lower half portion 22 are supported by the curved leg bases 26 via the curved legged portions 51, on the center line C of the casing 11, the center line C corresponding to the connection surface between the upper half portion 21 and the lower half portion 22. Therefore, when the casing 11 undergoes thermal expansion, the upper half portion 21 is thermally deformed upward with the center line C of the casing 11 as a starting point, and the lower half portion 22 is thermally deformed downward with the center line C of the casing 11 as a starting point, and thus the vertical direction shift between the center of the casing 11 and the center of the turbine 12 accommodated inside the casing 11 is reduced.

As described above, in the steam turbine casing of the fifth embodiment, the lower half portion 22, in which the multiple curved legged portions 24 protruding in the horizontal direction around the lower half portion main body 23 are provided, the upper half portion 21, which is connected onto the lower half portion 22, and in which the multiple curved legged portions 51 protruding in the horizontal direction around the upper half portion main body 25 are provided, the shrink bands 52 that connect the respective curved legged portions 51 and 24 together, and the curved leg bases 26, each of which has the lower end portion arranged on the frame 27 and has the upper end portion to which the lower surface portion of the curved legged portion 51 is fixed, are provided.

Therefore, since the lower half portion 22 is supported via the curved legged portions 51, on the center line C of the casing 11, the center line C corresponding to the connection surface between the upper half portion 21 and the lower half portion 22, upon thermal expansion, the upper half portion 21 and the lower half portion 22 are thermally deformed upward and downward with the center line C of the casing 11 as a starting point, and thus the vertical direction shift between the center of the casing 11 and the center of the turbine 12 accommodated inside the casing 11 is reduced. As a result, thermal deformation of the casing 11 is able to be reduced and a proper clearance is able to be maintained between the casing 11 and the turbine 12. Further, without use of another member, the lower half portion 22 is able to be rigidly supported by the curved leg bases 26.

In the steam turbine casing of the fifth embodiment, by the curved legged portion 51 of the upper half portion 21 and the curved legged portion 24 of the lower half portion 22 being connected together with the shrink band 52, independent thermal deformation of the respective curved legged portions 51 and 24 is able to be prevented.

Sixth Embodiment

Figure 13:
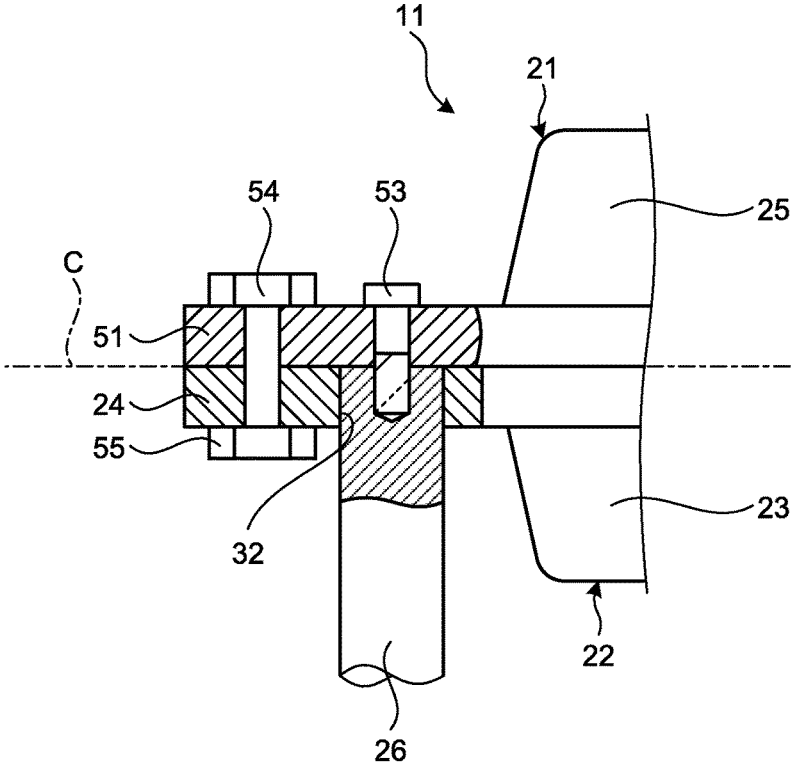
FIG. 13 is a longitudinal sectional view illustrating a support structure of a steam turbine casing according to a sixth embodiment.

FIG. 13 is a longitudinal sectional view illustrating a support structure of a steam turbine casing of a sixth embodiment. The same signs will be appended to parts having functions that are the same as those of the above described embodiments, and detailed description thereof will be omitted.

In the sixth embodiment, as illustrated in FIG. 13, the casing 11 has the upper half portion 21, the lower half portion 22, and the curved leg bases 26.

The upper half portion 21 has the upper half portion main body 25 and the four curved legged portions 51, and the lower half portion 22 has the lower half portion main body 23 and the four curved legged portions 24. The upper half portion 21 and the lower half portion 22 have the same shape in a plan view thereof, the upper half portion 21 is placed on the lower half portion 22, and the upper half portion 21 and the lower half portion 22 are connected to each other by bolts not illustrated. Further, the curved legged portion 24 of the lower half portion 22 has the through hole 32 formed therein, which is along the vertical direction. The curved legged portion 51 of the upper half portion 21 is in close contact with the upper surface portion of the curved legged portion 24 so as to cover the through hole 32 over the curved legged portion 24 of the lower half portion 22. The curved legged portions 51 and 24 are fixed together by a fixing bolt (connection member) 54 penetrating through the distal end portions of the curved legged portions 51 and 24 and a nut 55 being screwed thereon. Further, the upper end portions of the respective curved leg bases 26 are inserted into the through holes 32 of the curved legged portions 24 from therebelow, the upper end surfaces of the respective curved leg bases 26 are in close contact with the lower surface portions of the curved legged portions 51, and the respective curved leg bases 26 are fixed by the fixing bolts 53.

Since functions of this embodiment are the same as those of the above described fifth embodiment, description thereof will be omitted.

As described above, in the steam turbine casing of the sixth embodiment, the lower half portion 22, in which the multiple curved legged portions 24 protruding in the horizontal direction around the lower half portion main body 23 are provided, the upper half portion 21, which is connected onto the lower half portion 22, and in which the multiple curved legged portions 51 protruding in the horizontal direction around the upper half portion main body 25 are provided, the fixing bolts 54 and the nuts 55, which connect the respective curved legged portions 51 and 24 together, and the curved leg bases 26, each of which has the lower end portion arranged on the frame 27 and has the upper end portion to which the lower surface portion of the curved legged portion 51 is fixed, are provided.

Accordingly, upon thermal expansion, the upper half portion 21 and the lower half portion 22 are thermally deformed upward and downward with the center line C of the casing 11 as a starting point, and thus the vertical direction shift between the center of the casing 11 and the center of the turbine 12 accommodated inside the casing 11 is reduced. As a result, thermal deformation of the casing 11 is able to be reduced and a proper clearance is able to be maintained between the casing 11 and the turbine 12. Further, without use of another member, the lower half portion 22 is able to be rigidly supported by the curved leg bases 26. Furthermore, by the curved legged portion 51 of the upper half portion 21 and the curved legged portion 24 of the lower half portion 22 being connected to each other with the fixing bolt 54 and the nut 55, independent thermal deformation of the respective curved legged portions 51 and 24 is able to be prevented.

Seventh Embodiment

Figure 14:
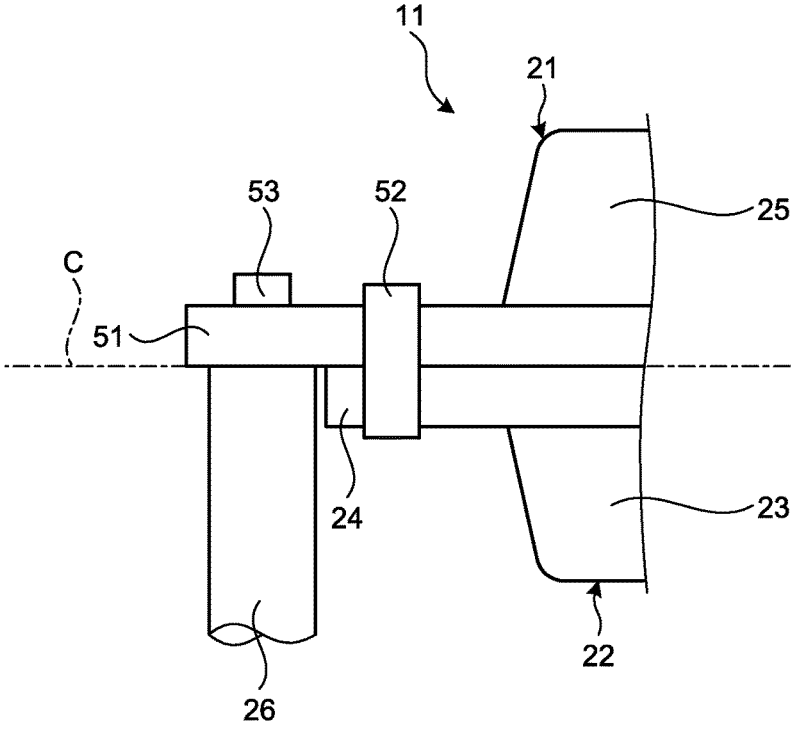
FIG. 14 is a front view illustrating a support structure of a steam turbine casing according to a seventh embodiment.

FIG. 14 is a front view illustrating a support structure of a steam turbine casing of a seventh embodiment. The same signs will be appended to parts having functions that are the same as those of the above described embodiments, and detailed description thereof will be omitted.

In the seventh embodiment, as illustrated in FIG. 14, the casing 11 has the upper half portion 21, the lower half portion 22, and the curved leg bases 26.

The upper half portion 21 has the upper half portion main body 25 and the four curved legged portions 51, and the lower half portion 22 has the lower half portion main body 23 and the four curved legged portions 24. Each of the curved legged portions 51 of the upper half portion 21 is formed longer than the respective curved legged portions 24 of the lower half portion 22. The curved legged portion 51 of the upper half portion 21 is in close contact with the upper surface portion of the curved legged portion 24 of the lower half portion 22. The curved legged portions 51 and 24 are fixed together by the shrink band 52 (or the fixing bolt 54/see FIG. 13). Further, the upper end surfaces of the respective curved leg bases 26 are in close contact with the lower surface portions at the distal end portions of the curved legged portions 51, and the respective curved leg bases 26 are fixed by the fixing bolts 53.

Since functions of this embodiment are the same as those of the above described fifth and sixth embodiments, description thereof will be omitted.

As described above, in the steam turbine casing of the seventh embodiment, the lower half portion 22, in which the multiple curved legged portions 24 protruding in the horizontal direction around the lower half portion main body 23 are provided, the upper half portion 21, which is connected onto the lower half portion 22, and in which the multiple curved legged portions 51 protruding in the horizontal direction around the upper half portion main body 25 are provided, the shrink bands 52 (or the fixing bolts 54), which connect the respective curved legged portions 51 and 24 together, and the curved leg bases 26, each of which has the lower end portion arranged on the frame 27 and has the upper end portion to which the lower surface portion at the distal end portion of the curved legged portion 51 is fixed, are provided.

Accordingly, upon thermal expansion, the upper half portion 21 and the lower half portion 22 are thermally deformed upward and downward with the center line C of the casing 11 as a starting point, and thus the vertical direction shift between the center of the casing 11 and the center of the turbine 12 accommodated inside the casing 11 is reduced. As a result, thermal deformation of the casing 11 is able to be reduced and a proper clearance is able to be maintained between the casing 11 and the turbine 12. Further, through holes of the curved legged portions 24 of the lower half portion 22 do not need to be formed, and thus the structure is able to be simplified.

Eighth Embodiment

Figure 15:
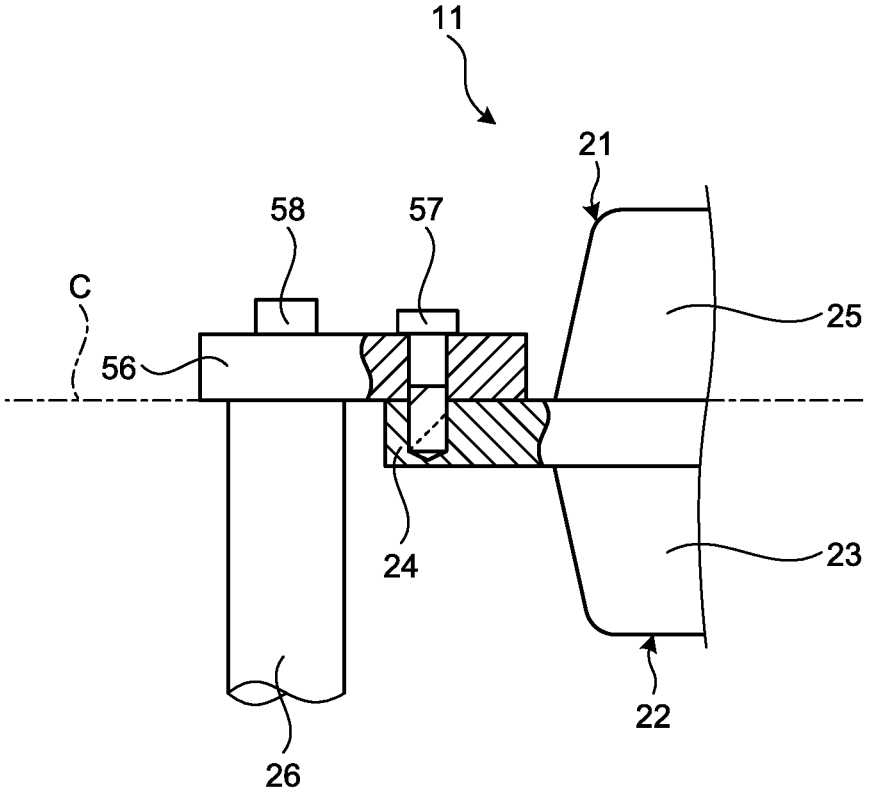
FIG. 15 is a longitudinal sectional view illustrating a support structure of a steam turbine casing according to an eighth embodiment.

FIG. 15 is a longitudinal sectional view illustrating a support structure of a steam turbine casing of an eighth embodiment. The same signs will be appended to parts having functions that are the same as those of the above described embodiments, and detailed description thereof will be omitted.

In the eighth embodiment, as illustrated in FIG. 15, the casing 11 has the upper half portion 21, the lower half portion 22, the curved leg bases 26, and coupling members 56.

The curved legged portion 24 is a flat plate shaped member having a horizontal rectangular shape, and one of longitudinal end portions of the curved legged portion 24 is integrally coupled to the lower half portion main body 23. The coupling member (support member) 56 is a flat plate shaped member having a horizontal rectangular shape, has a predetermined length, and formed with a width that is the same as that of the curved legged portion 24. A lower surface of one of end portions of the coupling member 56 is in close contact with the upper surface portion of the curved legged portion 24, a fixing bolt 57 penetrates through the coupling member 56 from thereabove and is screwed into the curved legged portion 24, and thereby, the coupling member 56 is fixed to the curved legged portion 24. Further, the upper end surface of each of the curved leg bases 26 is in close contact with a lower surface portion at the other end portion of the coupling member 56, a fixing bolt 58 penetrates through the coupling member 56 from thereabove and is screwed into the curved leg base 26, and thereby the coupling member 56 is fixed to the curved leg base 26.

Since functions of this embodiment are the same as those of the above described fifth and sixth embodiments, description thereof will be omitted.

As described above, in the steam turbine casing of the eighth embodiment, the lower surface of the one end portion of the coupling member 56 is in close contact with the upper surface of the curved legged portion 24 of the lower half portion 22, and the upper end portion of the curved leg base 26 is fixed to the lower surface portion of the other end portion of the coupling member 56.

Therefore, upon thermal expansion, the upper half portion 21 and the lower half portion 22 are thermally deformed upward and downward with the center line C of the casing 11 as a starting point, and thus the vertical direction shift between the center of the casing 11 and the center of the turbine 12 accommodated inside the casing 11 is reduced. As a result, thermal deformation of the casing 11 is able to be reduced and a proper clearance is able to be maintained between the casing 11 and the turbine 12. Further, by the curved legged portions 24 of the lower half portion 22 and the curved leg bases 26 being coupled to each other with the coupling members 56, the structure is able to be simplified.

Ninth Embodiment

Figure 16:
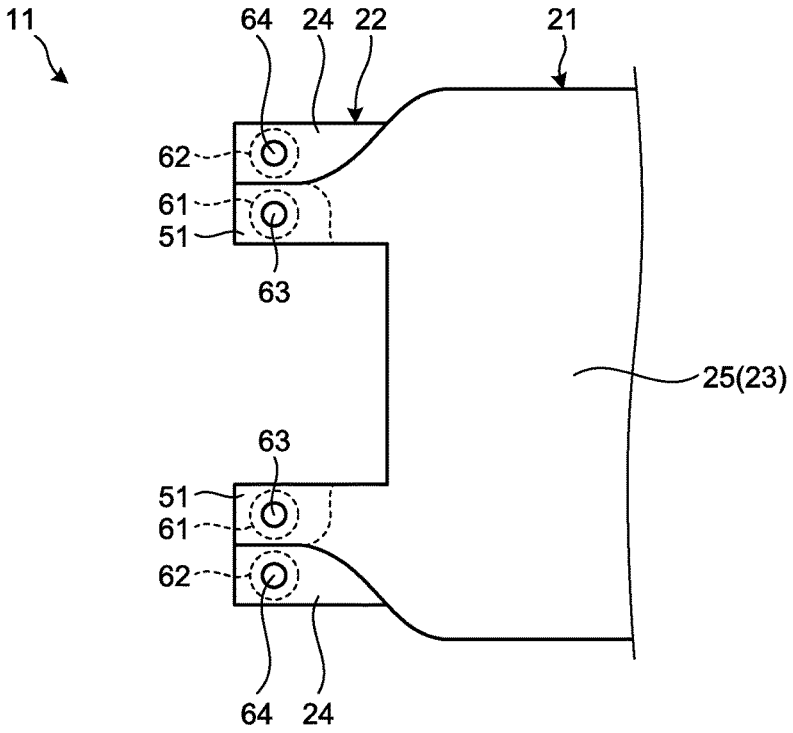
FIG. 16 is a plan view of main parts illustrating a steam turbine casing according to a ninth embodiment.
Figure 17:
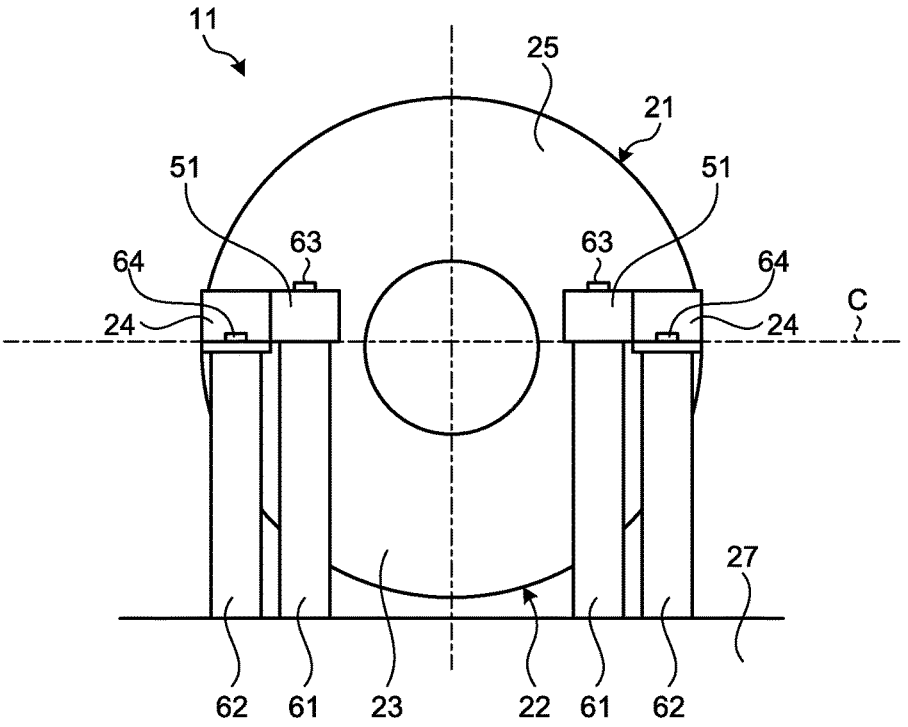
FIG. 17 is a side view of the steam turbine casing.

FIG. 16 is a plan view of main parts illustrating a steam turbine casing of a ninth embodiment, and FIG. 17 is a side view illustrating the steam turbine casing. The same signs will be appended to parts having functions that are the same as those of the above described embodiments, and detailed description thereof will be omitted.

In the ninth embodiment, as illustrated in FIG. 16 and FIG. 17, the casing 11 has the upper half portion 21, the lower half portion 22, and curved leg bases 61 and 62.

The upper half portion 21 has the upper half portion main body 25 and the four curved legged portions 51, and the lower half portion 22 has the lower half portion main body 23 and the four curved legged portions 24. The respective curved legged portions 51 and 24 are formed to protrude horizontally outward from outer peripheries of the upper half portion main body 25 and the lower half portion main body 23. The upper half portion main body 25 and the lower half portion main body 23 have the same shape in a plan view thereof, the upper half portion 21 is placed on the lower half portion 22, and the upper half portion 21 and the lower half portion 22 are connected to each other by bolts not illustrated. The curved legged portions 51 of the upper half portion 21 and the curved legged portions 24 of the lower half portion 22 are provided to be shifted from each other, in a plan view thereof, in the horizontal direction orthogonal to the axial direction of the rotor 13.

Further, the casing 11 has four curved leg bases (upper support columns) 61, and four curved leg bases (lower support columns) 62. Each of the curved leg bases 61 and 62 is formed in a column shape (or prism shape), and provided to erect along the vertical direction. That is, the lower end portion of each of the curved leg bases 61 and 62 is fixed to a predetermined position on the frame 27, and the curved legged portions 51 in the upper half portion 21 and the curved legged portions 24 in the lower half portion 22 are supported by the upper end portions of the curved leg bases 61 and 62 respectively. The respective curved leg bases 61 and 62 are adjacent to each other with a predetermined interval therebetween in the horizontal direction orthogonal to the axial direction of the rotor 13.

The respective curved legged portions 51 and 24 have substantially the same shape and same dimensions, one of the longitudinal end portions of the respective curved legged portions 51 and 24 are integrally coupled to the upper half portion main body 25 and the lower half portion main body 23, and the respective curved legged portions 51 and 24 are shifted from each other in the horizontal direction orthogonal to the axial direction of the rotor 13. The upper end surface of each of the curved leg bases 61 is in close contact with the lower surface portion of the curved legged portion 51 of the upper half portion 21, a fixing bolt 63 penetrates through the curved legged portion 51 from thereabove and is screwed into the curved leg base 61, and thereby, the curved legged portion 51 is fixed to the curved leg base 61. Further, the upper end surface of each of the curved leg bases 62 is in close contact with the lower surface portion of the curved legged portion 24 of the lower half portion 22, a fixing bolt 64 penetrates through the curved legged portion 24 from thereabove and is screwed into the curved leg base 62, and thereby, the curved legged portion 24 is fixed to the curved leg base 62.

In this embodiment, a vertical direction thickness of the curved legged portion 24 of the lower half portion 22 is set to be thinner than a vertical direction thickness of the curved legged portion 51 of the upper half portion 21.

Accordingly, the upper half portion 21 is connected onto the lower half portion 22, and the curved legged portions 51 and 24 are respectively supported by the different curved leg bases 61 and 62. The upper half portion 21 and the lower half portion 22 are supported by the curved leg bases 61 via the curved legged portions 51 and by the curved leg bases 62 via the curved legged portions 24 respectively, on the center line C of the casing 11, the center line C corresponding to the connection surface between the upper half portion 21 and the lower half portion 22. Therefore, when the casing 11 undergoes thermal expansion, the upper half portion 21 is thermally deformed upward with the center line C of the casing 11 as a starting point, and the lower half portion 22 is thermally deformed downward with the curved legged portions as a starting point. However, since the thickness of the curved legged portion 24 is thinner than the thickness of the curved legged portion 51, the amount of thermal expansion of the curved legged portion 24 is small, and the vertical direction shift between the center of the casing 11 and the center of the turbine 12 accommodated inside the casing 11 is reduced.

As described above, in the steam turbine casing of the ninth embodiment, the lower half portion 22, in which the multiple curved legged portions 24 protruding in the horizontal direction around the lower half portion main body 23 are provided, the upper half portion 21, which is connected onto the lower half portion 22, and in which the multiple curved legged portions 51 protruding in the horizontal direction around the upper half portion main body 25 are provided, the curved leg bases 61, each of which has the upper end portion, to which the lower surface portion of the curved leg portion 51 is fixed, and the curved leg bases 62, each of which has the upper end portion, to which the lower surface portion of the curved leg portion 24 is fixed, are provided, and the thickness of the curved legged portion 24 in the lower half portion 22 is set to be thinner than the thickness of the curved legged portion 51 in the upper half portion 21.

Therefore, since the upper half portion 21 is supported by the curved leg bases 61 via the curved legged portions 51 on the center line C of the casing 11, the center line C corresponding to the connection surface between the upper half portion 21 and the lower half portion 22, upon thermal expansion, the upper half portion 21 is thermally deformed upward and downward with the center line C of the casing 11 as a starting point. On the contrary, the lower half portion 22 is supported by the curved leg bases 62 via the curved legged portions 24, but since the thickness of the curved legged portions 24 is thin, the amount of the thermal expansion thereof is small, and the vertical direction shift between the center of the casing 11 and the center of the turbine 12 accommodated inside the casing 11 is reduced. As a result, thermal deformation of the casing 11 is able to be reduced and a proper clearance is able to be maintained between the casing 11 and the turbine 12.

In the above described embodiments, the shape of the upper half portion main body and the lower half portion main body are not limited to those described in the respective embodiments, and may be set as appropriate according to the shape and dimensions of the turbine 12. Further, the curved leg bases (support columns) are not limited to those described in the respective embodiments, and may be set as appropriate.

Further, in the above described embodiments, the casing 11 has four curved leg bases (support columns) 26, but not being limited to this configuration. For example, the casing may have two curved leg bases (support columns) 26 on one side.

According to the embodiments described above, each of the multiple lower support portions has a through hole provided therein, the through hole being along a vertical direction, the upper end portion of each of the multiple support columns is inserted into the through hole, and an upper end surface of each of the multiple support columns is in close contact with the lower surface portion of each of the multiple support members.

Therefore, by the upper end portion of the support column being inserted into the through hole and the upper end surface being in close contact with the lower surface portion of the support member, sufficient stiffness of the support column is able to be obtained.

According to the embodiments described above, each of the multiple support members is a cover member that covers over the through hole.

Therefore, by the support member being the cover member, without change in a structure of the upper half portion, strong coupling between the support column and the lower half portion is enabled easily.

According to the embodiments described above, a gap is provided between the through hole and each of the multiple support columns, and the through hole is open toward each of the multiple support members.

Therefore, by provision of the gap between the through hole and the support column, natural convection is caused in this gap, and thus temperature increase of the lower half portion is able to be reduced and thermal deformation thereof is able to be reduced.

According to the embodiments described above, a heat insulating material is provided between the through hole and each of the multiple support columns.

Therefore, by provision of the heat insulating material between the through hole and the support column, heat transfer from the lower half portion to the support column is able to be reduced and thermal deformation of the support column is able to be reduced.

According to the embodiments described above, a heat shielding material is provided between the through hole and each of the multiple support columns.

Therefore, by provision of the heat shielding material between the through hole and the support column, transfer of radiant heat from the lower half portion to the support column is able to be reduced and thermal deformation of the support column is able to be reduced.

According to the embodiments described above, each of the multiple support members is an upper support portion that protrudes in the horizontal direction around an upper half portion main body forming the upper half portion.

Therefore, just by forming the support member as the upper support portion of the upper half portion, strong coupling between the support column and the lower half portion is enabled easily.

According to the embodiments described above, each of the multiple upper support portions and each of the multiple lower support portions are connected to each other by a connection member.

Therefore, by the upper support portion and the lower support portion being connected to each other by the connection member, independent thermal deformation of the upper support portion and the lower support portion is able to be prevented.

According to the embodiments described above, each of the multiple support members is an upper support portion that protrudes in the horizontal direction around an upper half portion main body forming the upper half portion, and each of the multiple upper support portions and each of the multiple lower support portions are connected to each other by a connection member.

Therefore, just by forming the support member as the upper support portion of the upper half portion, and the upper support portion and the lower support portion being connected to each other by the connection member, strong coupling between the support column and the lower half portion is enabled easily. And by the upper support portion and the lower support portion being connected to each other by the connection member, independent thermal deformation of the upper support portion and the lower support portion is able to be prevented.

According to the embodiments described above, each of the multiple support members is a coupling member that couples each of the multiple lower support portions and each of the multiple support columns to each other.

Therefore, by forming the support member as the coupling member coupling the lower support portion and the support column to each other, the structure is able to be simplified.

According to a steam turbine casing of the present invention, since a support member is fixed to an upper surface portion of a lower support portion, and a lower surface portion of the support member is fixed to an upper end portion of a support column, thermal deformation of the casing is able to be reduced and a proper clearance is able to be maintained between the casing and a turbine.

Although this disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A steam turbine casing, having:

a lower half portion having a plurality of lower support portions protruding in a horizontal direction around a lower half portion main body thereof;

an upper half portion connected onto the lower half portion;

a plurality of support members each of which is fixed to an upper surface portion of a respective one of the lower support portions; and a plurality of support columns each having a lower end portion arranged on a frame and an upper end portion to which a lower surface portion of a respective one of the support members is fixed on a center line of the steam turbine casing in a vertical direction along a longitudinal direction of the respective one of the support members, the center line corresponding to a connection surface between the upper half portion and the lower half portion;

wherein each of the lower support portions has a through hole extending in the vertical direction, the upper end portion of a respective one of the support columns is inserted into the through hole of each of the lower support portions, and an upper end surface of each of the support columns is in close contact with the lower surface portion of a respective one of the plurality of support members.

2. The steam turbine casing according to claim 1, wherein each of the support members is a cover member that covers over the through hole of a respective one of the lower support portions.

3. The steam turbine casing according to claim 1, wherein a gap is provided between the through hole of each of the lower support portions and a respective one of the support columns, and a first part of the through hole of each of the lower support portions is covered and a second part of the through hole of each of the lower support portions is open toward a respective one of the support members.

4. The steam turbine casing according to claim 3, wherein a heat shielding material is provided between the through hole of each of the lower support portions and a respective one of the support columns.

5. The steam turbine casing according to claim 1, wherein a heat insulating material is provided between the through hole of each of the lower support portions and a respective one of the support columns.

6. The steam turbine casing according to claim 1, wherein the plurality of support members is are upper support portions protruding in the horizontal direction around an upper half portion main body forming the upper half portion.

7. The steam turbine casing according to claim 6, wherein each of the upper support portions is connected to a respective one of the lower support portions by a connection member.

8. The steam turbine casing according to claim 1, wherein each of the multiple support members is a coupling member that couples a respective one of the lower support portions to a corresponding one of the support columns.

* * * * *